United States Patent [19]

Reil

[11] Patent Number: 4,994,011

[45] Date of Patent: Feb. 19, 1991

[54] APPARATUS FOR FOLDING INTO AN OPEN STATE SLEEVES WHICH ARE LYING FLAT

[75] Inventor: Wilhelm Reil, Bensheim, Fed. Rep. of Germany

[73] Assignee: Tera Pak Finance & Trading S.A., Pully, Switzerland

[21] Appl. No.: 309,778

[22] Filed: Feb. 9, 1989

[30] Foreign Application Priority Data

Feb. 16, 1988 [DE] Fed. Rep. of Germany ..... 3804791

[51] Int. Cl.[5] ..... B31B 1/78; B31B 1/80

[52] U.S. Cl. ..... 493/316; 493/309; 493/313

[58] Field of Search ..... 493/316, 416, 480, 309, 493/313, 317; 53/565, 566

[56] References Cited

U.S. PATENT DOCUMENTS

| | | | |
|---|---|---|---|
| 2,881,682 | 4/1959 | Engleson et al. | 493/316 |
| 3,783,752 | 1/1974 | Langen et al. | 493/316 |
| 4,340,380 | 7/1982 | Calvert | 493/316 |
| 4,562,692 | 1/1986 | Scarpa et al. | 53/566 |
| 4,787,881 | 11/1988 | Andersson et al. | 493/316 |

FOREIGN PATENT DOCUMENTS

| | | |
|---|---|---|
| 1022959 | 7/1958 | Fed. Rep. of Germany . |
| 2743797 | 1/1981 | Fed. Rep. of Germany . |
| 3429761 | 2/1986 | Fed. Rep. of Germany . |

*Primary Examiner*—Frederick R. Schmidt
*Assistant Examiner*—Jack Lavinder
*Attorney, Agent, or Firm*—Paul & Paul

[57] ABSTRACT

Apparatus for opening flat folded sleeve packaging into a parallelepiped packaging shape and for positioning that packaging for further manufacture which includes a feeder pivotable through a quarter-circle so as to grasp the flat sleeve from a source and to guide the sleeve to a position in axial alignment with a spaced apart mandrel and ejector, the mandrel being adapted to receive the parallelepiped sleeve by the action of the ejector, a V-shaped abutment positioned to receive a leading folded edge of the sleeve at the quarter-circle position of the feeder, and a V-shaped aligned pair of pivoting levers adjacent the V-shaped abutment, the pivoting levers having bearing planes formed thereon and having vacuum apertures formed therein, the levers adapted to function to open a sleeve supported thereby in cooperation with the feeder and the abutment, the bearing planes of the lever providing guiding support for the opened sleeve upon action of the ejector thereon.

8 Claims, 13 Drawing Sheets

Fig.10
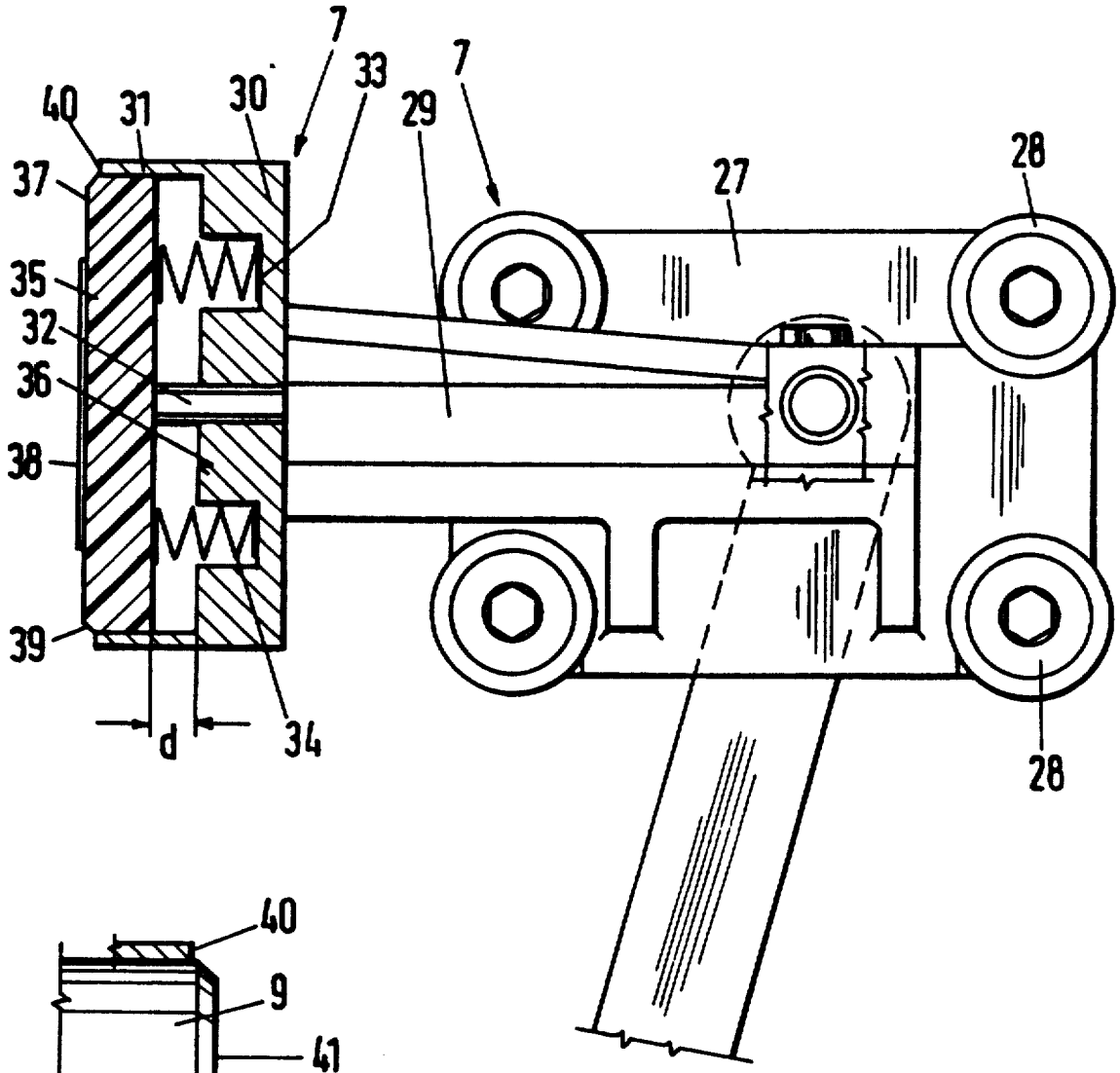
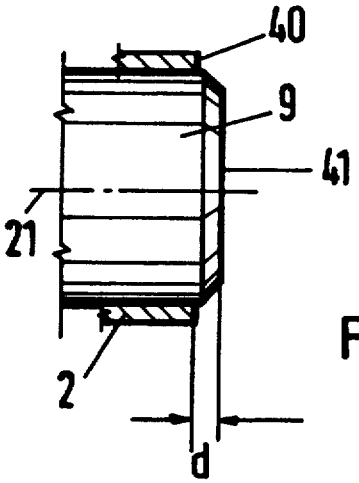
Fig.10a

APPARATUS FOR FOLDING INTO AN OPEN STATE SLEEVES WHICH ARE LYING FLAT

BACKGROUND OF THE INVENTION

The invention relates to an apparatus for folding into an open state sleeves which are lying flat and which consist of paper, cardboard or the like, and which comprise a longitudinal sealing seam, particularly for the manufacture of liquids packagings, and also a feeder for grasping the flat sleeve and introducing it into a position in which it is axially aligned between a mandrel and an ejector.

The invention is directed at all kinds of sleeves which are used in particular for producing packagings to contain flowing media, and by way of illustration and for better understanding, it will be described with reference to liquids packagings.

Packagings are already known for milk, juices and the like, which comprise a sleeve consisting of paper which is coated with a synthetic plastics material, one end of the sleeve being sealed by being folded into a rectangular bottom, the other and opposite end of the sleeve being provided with an integrally moulded lid with no carrier material, i.e. a pure synthetic plastics material. Here, sleeves in the form of a tube are known which have a substantially circular cross-section. Machines constructed to manufacture such packagings comprise at least one shaping wheel with a plurality of mandrels, firstly the sleeve being formed from a paper web (coated with synthetic plastics material) as a longitudinal sealing seam is formed, after which the sleeve is pushed onto the mandrel so that what will subsequently be the lid and which also includes the pouring means, can be injection moulded on at one end. The mandrel onto which the sleeve is pushed constitutes virtually the inner mould about which a two-part outer mould is placed so that the end of the sleeve can be so connected to the injection moulded synthetic plastics material that the packaging receives its lid which is integrally moulded on in fluid-tight fashion.

Liquids packagings of this type and also other forms of liquids packagings are used as disposable containers to an ever increasing extent by the end user and are therefore marketed. The corresponding filling machines and also packaging producing machines must have a relatively high output, i.e. for a given unit of time, more packagings must be produced and thus also more sleeves must be pushed onto mandrels and provided with end walls.

From the point of view of saving material, the trend has been to go over to thinner sleeve walls, so that handling of the sleeve and its processing in the packaging producing machine is certainly not simplified.

In the case of the aforementioned round package which has a rectangular bottom and a round lid, manufacture is carried out in a machine in which firstly the sleeve is offered in a lying-flat state after which it is passed via a feeder in between the mandrel and an ejector, the sleeve being opened up from the flat state into a circular cross-section. By reason of the circular cross-section, it is immaterial at which location on the periphery, seen in cross-section, the longitudinal sealing seam by which the flat sheet is formed into the sleeve, is disposed.

In the meantime, attempts have also been made to produce cross-sectionally rectangular liquids packagings, in which case sleeves are likewise used, being produced by the making of a longitudinal sealing seam, preferably a sealing seam having overlapping end portions.

With regard to the manufacture of the parallelepiped liquids packaging, the bottom is formed from the paper material itself by folding, while at the opposite end the lid is integrally moulded on in a rectangular shape and incorporates the pouring device. This latter is so disposed that the pouring tip, in a plan view of the packaging from the lid end, points to a corner thereof and is disposed in the vicinity thereof. On grounds of strength and so that the end user can readily grasp and handle the package, it has proved to be advantageous if the longitudinal sealing seam is disposed on the adjacent lateral folded edge in relation to the pouring orifice. In fact, one can easily imagine that the doubled-over marginal strip means that in the region of the longitudinal sealing seam the packaging is made more rigid. If, then, this rigid lateral fold edge is used as the point to which the end user applies his efforts, then this is the point at which the packaging bends least readily and where depressions or damage should be least feared when the packaging is grasped and gripped between the thumb and the other four fingers of the hand. Since the greatest pressure is applied to the packaging via the thumb (it is greater than the other four fingers' pressure), it is a good idea if the lateral seam of the packaging sleeve with the longitudinal sealing seam is so located that the pouring device in the lid is disposed at the top and transversely thereto so that during pouring the plane of the poured stream passes through those two lateral folded edges in the vicinity of one of which the tip of the pouring orifice is disposed while in the vicinity of the other of which the four fingers of the user are applied in order to pour out the contents, while the thumb is applied to the lateral fold edge of the sleeve which is disposed transversely thereto and which is reinforced by the longitudinal sealing seam.

If these considerations are taken into account where the manufacturing machine is concerned, then, particularly in the case of a packaging having a cross-sectionally rectangular shape, difficulties occur in that even with the high output of the packaging producing machine, it would be desirable to have the longitudinal sealing seam of the sleeve always on one specific edge of the mandrel. In other words, the feeder for gripping the lying-flat sleeve and also the measures and means of folding the sleeve open must be of such a configuration that the longitudinal sealing seam is always positioned at the desired location on the mandrel.

This consideration becomes particularly problematical when two shaping wheels are used at the same time, if sleeves have to be pushed onto two different mandrels one after the other and then, after the synthetic plastics lid has been moulded on, the packagings have to be brought into a row, filled, sealed and then carried away.

Also with packagings which are produced in such a way, the longitudinal sealing seams must always be in the same position.

Therefore, the inventor has set out to resolve the problem of so improving the apparatus for folding open sleeves of the aforesaid type which are lying flat that it is made possible with the new apparatus reliably to open out the lying-flat sleeve at a high working rate into a shape of rectangular cross-section, the longitudinal sealing seam always being in one specific position.

SUMMARY OF THE INVENTION

According to the invention, this problem is resolved in that the feeder comprises, pivotable about an axis parallel with the direction of linear movement of the ejector, a distributor-rocker having pivotable through a quarter-circle and about the axis a centring web, opposite the extreme outwardly pivoted position of which there is fixed a stationary folding abutment having V-wise disposed receiving surfaces and in that alongside the folding abutment there are on both sides pivoting levers with vacuum apertures which are so pivotable that two bearing planes which in each case define a pivoting lever span a V-shaped 'roof' corresponding to two adjacently disposed side faces of the folded-open sleeve, and in that the ejector has at the front a square plate and travels a distance greater than the length of the pivoting lever and is capable of reciprocating movement along the bearing planes which are arranged in a V-shape, controlled in synchronism with the pivoting movement of the distributor-rocker. Surprisingly novel is the fact that the feeder is constructed as a pivotable distributor-rocker which pivots about an axis which extends parallel with the longitudinal direction of the mandrel onto which the sleeve is intended to be pushed. This pushing takes place by virtue of the linear movement of the ejector, which is why the pivoting axis of the distributor-rocker is parallel with this direction of linear movement. The feeder transports a bottom sleeve which is removed from a stack of flat sleeves disposed for instance alongside a magazine, along a quarter-circle into the position between mandrel and ejector. When the sleeve in this position has been folded open into its completely quadratic shape, the ejector is switched on and pushes the sleeve onto the mandrel.

This folding open of the sleeve from its initially almost flat state into the cross-sectionally rectangular and preferably square condition takes place according to the invention via a stationary folding abutment which comprises receiving surfaces which are disposed in a V-shape so that the wide opening of the V is towards the arcuate path of the distributor-rocker.

It is necessary to imagine the sleeve-like blank as being singled out and located underneath the magazine in such a way that the sleeve is pressed flat along two oppositely disposed fold edges, the longitudinal sealing seam, in the cross-section of the flat sleeve, being disposed virtually in the centre above it, so that the further fold line which is alongside the longitudinal sealing seam is almost still flat and has virtually no fold in it. The position of the longitudinal sealing seam when the lying-flat blank which must be imagined as being horizontal has disposed in the middle "on top" between two "first" longitudinal fold edges is important. It has already been mentioned that in order to fold open the sleeve, fill and seal the packaging by means of the mandrel and further stations in the packaging producing machine, the sleeve must always be applied onto the mandrel in the same position. If one imagines looking at the end face of the mandrel while the sleeve is lying initially flat and in a horizontal plane, then by virtue of the quarter-circle, i.e. the movement of the distributor-rocker and transport of the sleeve, the longitudinal sealing seam moves from the initially "upper" position into the "left hand" position, because the centre point of the quarter-circle, i.e. also the pivoting axis of the distributor-rocker, is disposed for instance above the bottom lying-flat sleeve and—in the case of this present example—is to the left of that mandrel which is ready to receive a sleeve. The quarter-circle is therefore virtually a path which, if one imagines a watch, can be compared with the position from six o'clock to three o'clock. In the three o'clock position, the already somewhat opened-out sleeve is therefore propelled against the folding abutment so that its foremost of the two "first" lonitudinal fold edges is moved into the "downwardly" open V of the receiving surfaces of the folding abutment, into which the sleeve is pushed as far as it will go.

So that it is not only the folding abutment which takes care of positioning of the sleeve and so that there is also a supporting of the initially only slightly opened sleeve as it is folded open into the final rectangular state, there are on both sides of and alongside the folding abutment pivoting levers adapted to pivot about axes which likewise extend parallel with the pivoting axis of the distributor-rocker, parallel with the elongated folding abutment and disposed for example alongside and at the height thereof. Each pivoting lever has, pointing towards the space in which the sleeve is to be folded open, a bearing plane in which discharge vacuum orifices so that they engage the two side walls of the sleeve which are disposed alongside the leading "first" lateral fold edge and possibly assist the opening out or folding open process in that the relevant bearing plane raises the adjacent side wall of the sleeve, opening it out. The two pivoting levers with their bearing planes are so disposed alongside the folding abutment that the bearing planes, like the V-shaped receiving surfaces of the folding abutment, are also disposed V-wise and form a 'roof'. As will be described hereinafter, this roof shape, once again viewed in a direction parallel with the pivoting axis of the distributor-rocker, is constructed like a very sharply ridged roof and by virtue of the upwards pivoting, for instance of the left hand pivoting lever, clockwise from the seven o'clock position into the eight o'clock position and accordingly on the opposite side, pivoting of the other pivoting lever out of the five o'clock position into the four o'clock position, the V-shape of the roof opens out, while the sleeve is being folded open. During this opening out, the two lateral surfaces of the folded open sleeve, separated by the foremost of the "first" longitudinal fold edges, are sucked against the relevant bearing plane of the pivoting lever (and this happens on each pivoting lever).

If the path of the sleeve is further pursued, then this sleeve folded open into a complete parallelepiped form is on one side pushed onto the square plate of the ejector so that the ejector moves in the direction of its already aforementioned movement, namely in the direction of the mandrel which is ready to receive it. During this movement of the ejector, the square plate first strikes the rectangular rear edge of the sleeve, shapes it completely and retains it. During this continuous movement of the ejector, after the sleeve has been pushed onto the square plate, the full working stroke is performed, the sleeve passing under the V-shaped bearing planes of the pivoting levers, in fact parallel with the longitudinal direction of the pivoting levers and with the folding abutment, out of the space underneath the folding abutment and alongside the pivoting levers, and is finally pushed onto the mandrel.

Finally, it is already mentioned hereinabove that also the pivoting movement of the distributor-rocker is controlled in synchronism with this movement of the ejector. In the case of a preferred embodiment of the folding-open apparatus, in fact, after the leading lateral fold edge of the sleeve has struck the folding abutment, the distributor-rocker in fact assists the folding-open process in that it is controlled in synchronism with the movement of the pivoting levers and is initially retarded in its movement (when the pivoting levers have assumed the five o'clock and/or seven o'clock positions and after opening of the roof, i.e. movement of the pivoting levers into the four o'clock and eight o'clock positions respectively) and is then moved on a little farther towards the folding abutment until the bottom rear lateral fold edge of the sleeve is in its final folded-open position. When the ejector commences its pushing movement, the sleeve is retained in the pivoting levers by the vacuum and the distributor-rocker is able again to travel back through the quarter-circle and into the starting position in order to pick up the next singled-out and flat sleeve.

From the foregoing brief description of the movement of the distributor-rocker, pivoting levers and ejector, it is possible readily to appreciate the simple construction and pattern of movement, so that the firstly separated and lying-flat sleeve can be reliably opened out into a shape of rectangular cross-section, and in fact with the imposed condition that the longitudinal sealing seam always be disposed at a specific location, e.g. in the case of the embodiment being examined, on the left hand edge of the mandrel when one is looking at the end face of the mandrel which is ready to receive a sleeve. It is envisaged that the parallelepiped mandrel be so to speak diagonally disposed, i.e. the planes through its longitudinal outer edges are horizontal and vertical (in contrast to the "straight" disposition of a parallelepiped in which the diagonals passing through the cross-sectionally opened out corners are not horizontal and vertical but are in each case oblique thereto).

The invention is furthermore advantageously developed in that the distributor-rocker comprises an arm and, at its radially outer end, a retaining plate which is shaped like part of a cylinder and in that at at least one straight end edge of the retaining plate there is fixed a centring web having cross-sectionally V-shaped outwardly positioned receiving surfaces and in that a basket shaped like part of a cylindrical shell is rigidly mounted alongside the path of movement of the retaining plate. The arm of the distributor-rocker must be imagined as being a connecting element between its pivoting axis on the one hand and, at an arm's length from it, the retaining plate on the other. Viewed in the direction of the pivoting axis of the distributor-rocker, the retaining plate is arcuately shaped, a straight end edge being imagined at one end of the arc, the other edge being imagined at the other end of the arc. Disposed at least at one end edge there is an elongated centring web with the aforementioned receiving surfaces because within the framework of the above-mentioned imagined example of embodiment, the rearmost of the two "first" longitudinal fold edges of the as yet still flat sleeve is picked up by this centring web in a position when this has for example assumed an eight o'clock position, after which it passes through its quarter-circle into the four o'clock or three o'clock position in order arcuately to move the flat sleeve out of the position underneath the magazine into the position against the folding abutment. During this movement, the more or less flat-lying sleeve slides onto the partially cylindrically shaped basket disposed close beside the path of movement of the centring web.

According to the invention, it is expedient if the stationary folding abutment takes the form of a strip which is longer than the sleeve which is to be folded open and substantially as long as the pivoting lever, in the axial direction. The receiving surfaces of the folding abutment, disposed in a V-shape, are thus able to accommodate the entire front "first" longitudinal fold edge of the sleeve so that guidance is particularly reliable both prior to and during receiving of the sleeve and also during the folding-open process.

In the case of an expedient further development of the invention, the bearing plane of the relevant pivoting lever comprises recesses in which stationarily disposed rollers can be accommodated. The rollers serve to guide the folded-open sleeve during the outwards movement of the ejector. It is true that the rollers are rotatable about their longitudinal axes but for the rest they are immovably stationary and are so disposed on both sides and below the folding abutment that they in each case form a tangentially applied guide plane. Both guide planes then in turn form the desired V-shaped 'roof' to correspond to the two adjacently disposed side faces of the folded-open sleeve. The pivoting levers are adapted to move in relation to the stationary rollers, i.e. the recesses travel like gates beyond the rollers during movement of the pivoting levers. The bearing planes of the pivoting levers—viewed in cross section—may subtend a substantially more acute V in the initial position and a more obtuse or flatter V in their final position than the V which is defined by the rollers. Generally, this latter is right-angled.

According to the invention, it is furthermore advantageous if on that side of the folding abutment which is towards the mandrel of the machine there is a stationarily mounted guide bounding a square corresponding to the cross-section of the sleeve. This guide may be constituted of for example four elongated rollers or alternatively by stationary sliding members on which the folded-open sleeve is pushed by the ejector out of the space under the folding abutment and onto the mandrel. The particular advantage of this guide lies in its guiding function, as its name implies. In fact, when the square plate on the ejector has picked up the rear end of the folded-open sleeve and is supporting it, then the front end of the rectangularly opened-up sleeve enters the guide very soon after the ejector has started its movement and is then retained by the guide. In this way, already at the start of the ejector movement, the sleeve is supported at the front and rear at its rectangular edges, namely on the one hand by the guide which has just been mentioned and at the other by the square plate of the ejector. With advantage, then, the pivoting levers can open out to form the very open or obtuse V, so that during its further progress, the sleeve is still guided just by the rollers under the stationary folding abutment. The rolling friction avoids damage to the outer surface of the sleeve as it is ejected.

Furthermore, the invention is advantageously developed in that the ejector has a beaker-shaped housing in which the square plate is initially and resiliently tensioned in respect of the beaker bottom being disposed for linear movement at a distance from the said beaker bottom, and in that the edge of the square plate which corresponds to the peripheral contour of the folded-open sleeve is set inwardly obliquely. This last-mentioned feature, like a cone, encourages fitment of the rear edge of the sleeve on the square plate when the ejector starts its outwards movement. The resilient mounting of the square plate on the other hand has the advantage that the ejector can without damage move up until it contacts the end face of the mandrel and furthermore is able even to push the sleeve far enough onto the mandrel. The square plate which may be produced for example from synthetic plastics material preferably moves inside the beaker-shaped housing which is preferably made from steel so that in one position, at the start, the square plate projects farthest forwards out of the ejector and is therefore the first part which comes in contact with the end face of the mandrel: after it meets the end face of the mandrel, however, it stays back in relation to the beaker-shaped housing. This housing and in particular its cylindrical side walls (of the beaker) then move in relation to the square plate mounted on the end face of the mandrel and during this relative movement push further onto the mandrel the sleeve which is already partially pushed onto it, so that the rear edge of the sleeve virtually comes to a position in which it is spaced apart virtually from the end edge of the mandrel. This is desirable and serves for correctly positioning this rear edge of the sleeve on which then the synthetic plastics lid is subsequently to be injection moulded on the mandrel.

According to the invention, it is also expedient if a raised ring of elastomeric material is let into the front end face of the square plate. Such a raised ring damps impact of the ejector and particularly of its square plate against the end face of the mandrel, the ring preferably being produced from rubber. Its annular face may form an essential part of the cross-sectional surface of the sleeve and therefore constitute a good mounting and shock absorber for the ejector.

In the case of the previously described imaginary example, it has so far always been assumed that only one mandrel has to be charged with sleeves and that virtually the separated sleeve disposed in each case under the magazine has to be pushed only to one side by the distributor-rocker, namely over a quarter of a circle between the seven o'clock and the three o'clock positions. In order to increase the output and the working rate of a packaging producing machine, it is possible however also to dispose two shaping wheels and injection mould synthetic plastic lids simultaneously on two mandrels in order better to utilise the processing time in the packaging machine. For injection moulding the lid on the sleeve, in fact, more time is required (until the lid hardens out) than for filling and sealing the bottom by folding. Therefore, a machine has been made more powerful in that the filling and sealing stations of the packaging machine are supplied by two mandrels. However, this means that sleeves have to be fitted onto two mandrels in such a way that after the sleeves have been arranged, e.g. by the additional second "left hand" mandrel in the row of sleeves in which there are still gaps by the above-described "right hand" mandrel, the sleeves are always disposed in the same position in respect of their longitudinal sealing seam.

In order to satisfy these requirements, it is according to the invention suggested that both mandrels be disposed on opposite sides in relation to the distributor-rocker and thus also on opposite sides in relation to the sleeve magazine, the sleeves being fed to the left hand mandrel in a position displaced through 180° so that on the first or right hand mandrel the longitudinal fold edge is positioned for example at the edge which is disposed farthest left, while on the second or left hand mandrel this longitudinal sealing seam of the sleeve is positioned on that edge of the mandrel which is disposed farthest to the right. This rotation through 180° is in fact necessary because the arrangement of the packagings on the second or left hand mandrel is effected via an arcuate movement during which the sleeve or the sleeve and lid is rotated through 180° so that after arrangement all the sleeves both on the first and also on the second mandrels do in fact all have the longitudinal sealing seam on the same side.

For this, it is according to the invention advantageous if the distributor-rocker comprises two oppositely disposed centring webs and is disposed substantially centrally between two folding abutments with pivoting levers and is disposed to be pivotable through almost a semi-circle. In operation, in fact, the centring web mounted for example on the left, on the other straight end edge of the retaining plate of the distributor-rocker, during its return stroke from the position from the first right hand mandrel clockwise, already pushes the next separated and as yet still flat sleeve in a clockwise direction over a further quarter circle into the position between the second left hand mandrel and a second ejector. Once the sleeve has been brought into its final position on the first right hand mandrel and the lid has already been moulded into place, the ejector works on the second left hand mandrel and pushes the next sleeve into the right position on the second mandrel. It is evident that when the machine is doubled by providing two shaping wheels, the working rate is considerably improved.

BRIEF DESCRIPTION OF THE DRAWINGS

Further advantages, features and possibilities of application of the present invention will emerge from the ensuing description of preferred embodiments in conjunction with the appended drawings, in which:

FIG. 10 is a side view of the ejector with the drive lever shown as being broken away;

FIG. 10*a* is a side view of a mandrel having a sleeve mounted thereon, parts being broken away;

DESCRIPTION OF THE PREFERRED EMBODIMENTS

In the case of the embodiment described hereinafter, it is taken as the premise that the distributor-rocker is disposed "above" the basket and somewhat below and substantially in the middle between two shaping wheels, so that in other words the first shaping wheel must be imagined as being "above and to the right" while the second shaping wheel is thought to be "above and to the left". The lying-flat sleeve is pushed arcuately out of the position in the centre "bottom" in the "upwards" direction so that it is under the folding abutment. Anyway, a man skilled in the art will understand that with any other corresponding arrangement, both the sides and also top and bottom are interchangeable. Only for easier description and for better understanding is reference made here to "up" and "down" within the meaning suggested hereinabove.

Figure 6:
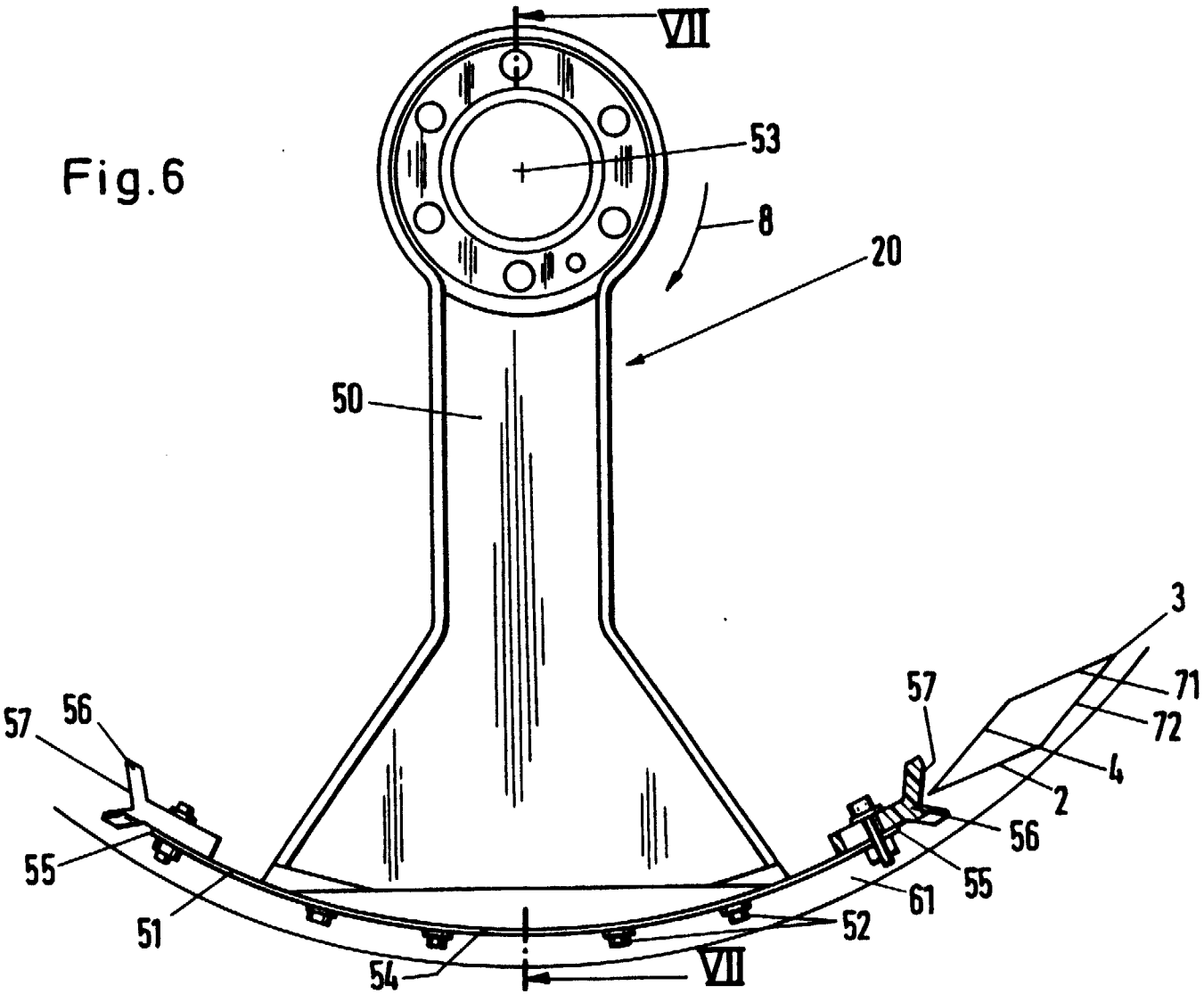
FIG. 6 is a view of the distributor-rocker in the direction of its pivoting axis.
Figure 7:
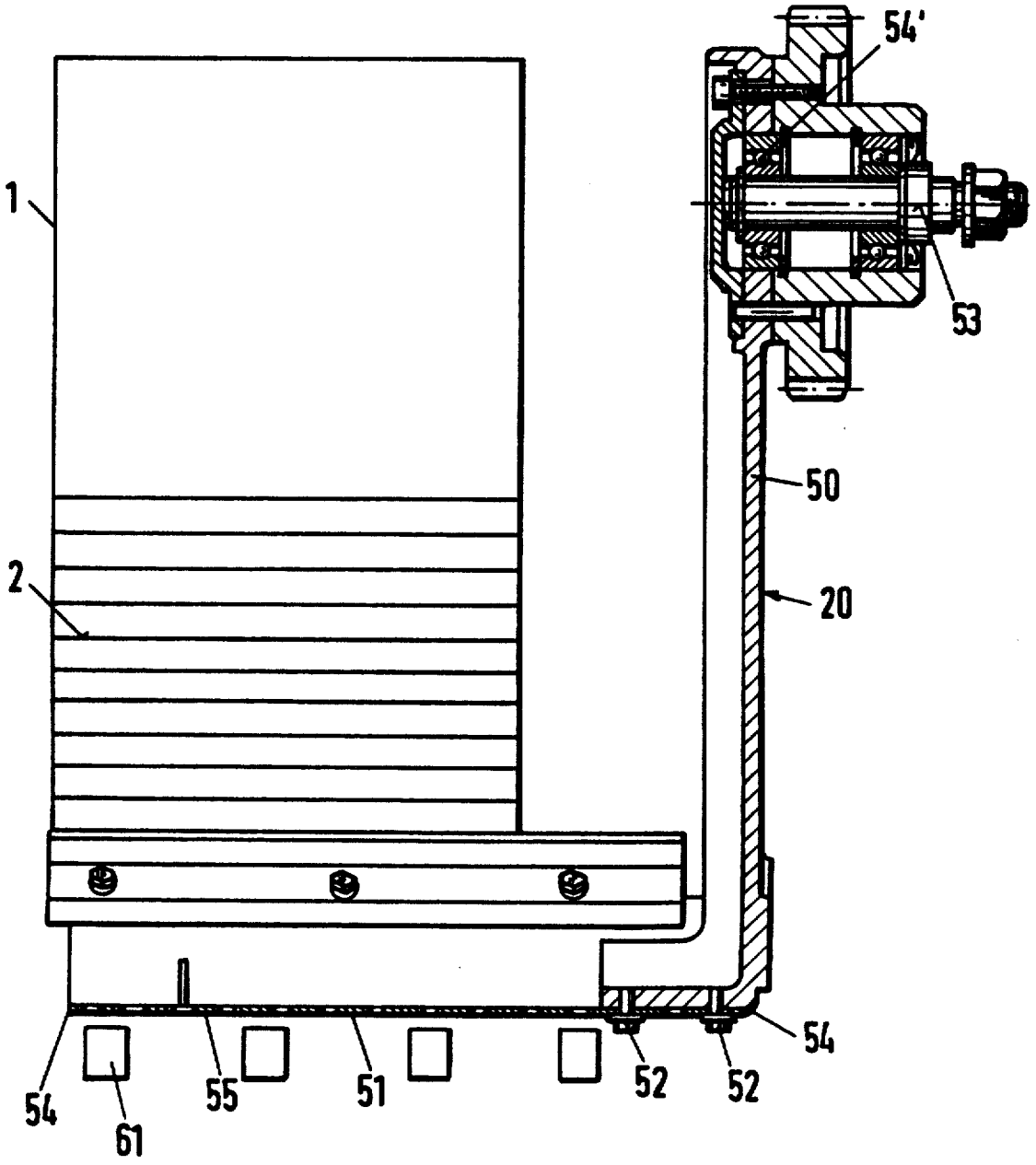
FIG. 7 is a view of the distributor-rocker taken on the line VII—VII in FIG. 6.

FIG. 7 shows the magazine 1 with lying-flat paper sleeves 2 which consist of paper material coated with synthetic plastics material. We are in fact looking at the front right hand one of the "first" longitudinal fold edges of the sleeve 2 designated 3 in the cross-sectional views (FIGS. 6 and 8), while the longitudinal sealing seam of the sleeve 2 is designated 4.

Figure 1:
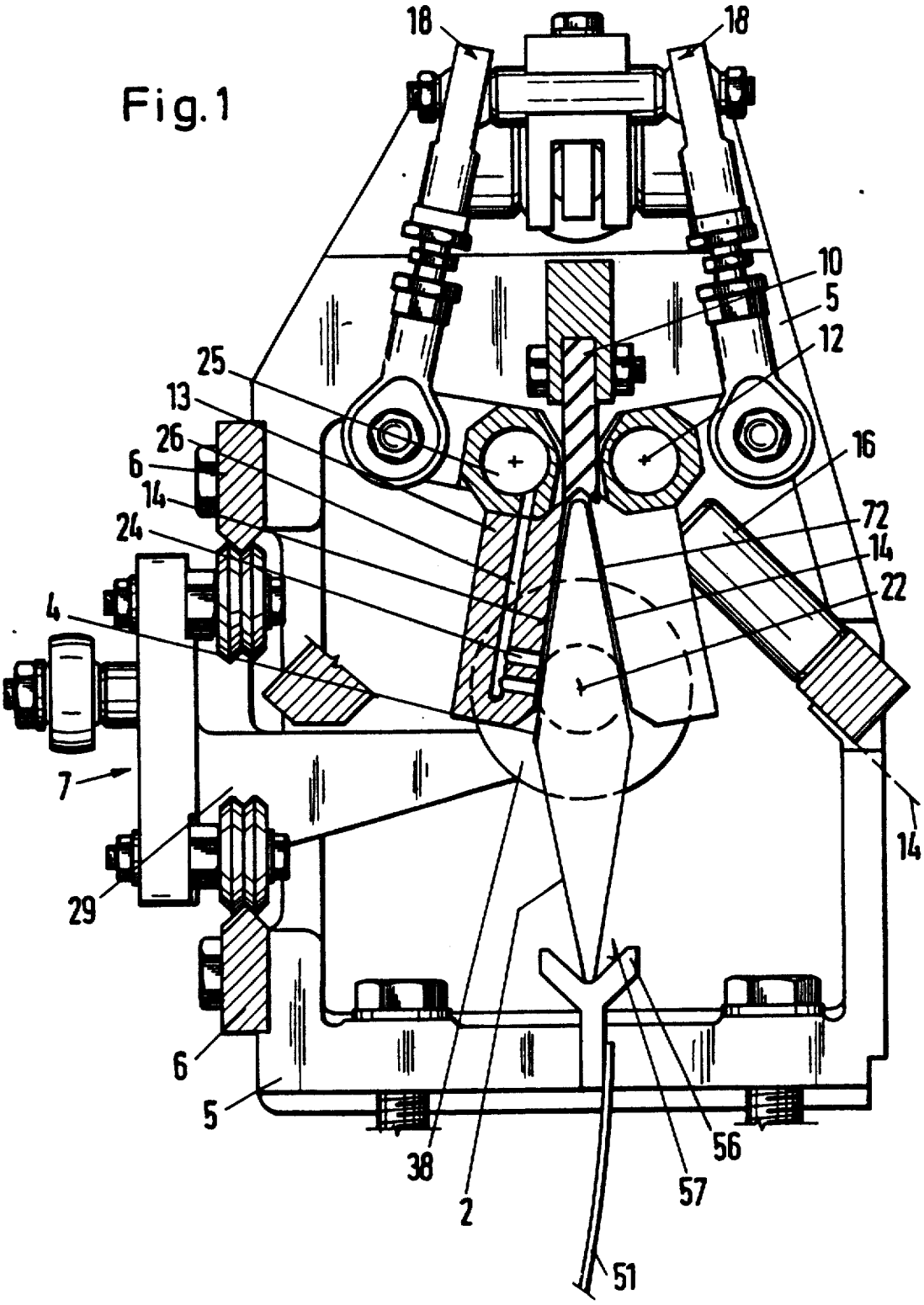
FIG. 1 is a vertical cross-sectional view through the folding-open apparatus with pivoting levers, stationary rollers, a part of the distributor-rocker shown in broken-away form, the sleeve and a plan view of the ejector, in fact in a first position shortly after pushing in the only partially opened out sleeve.
Figure 2:
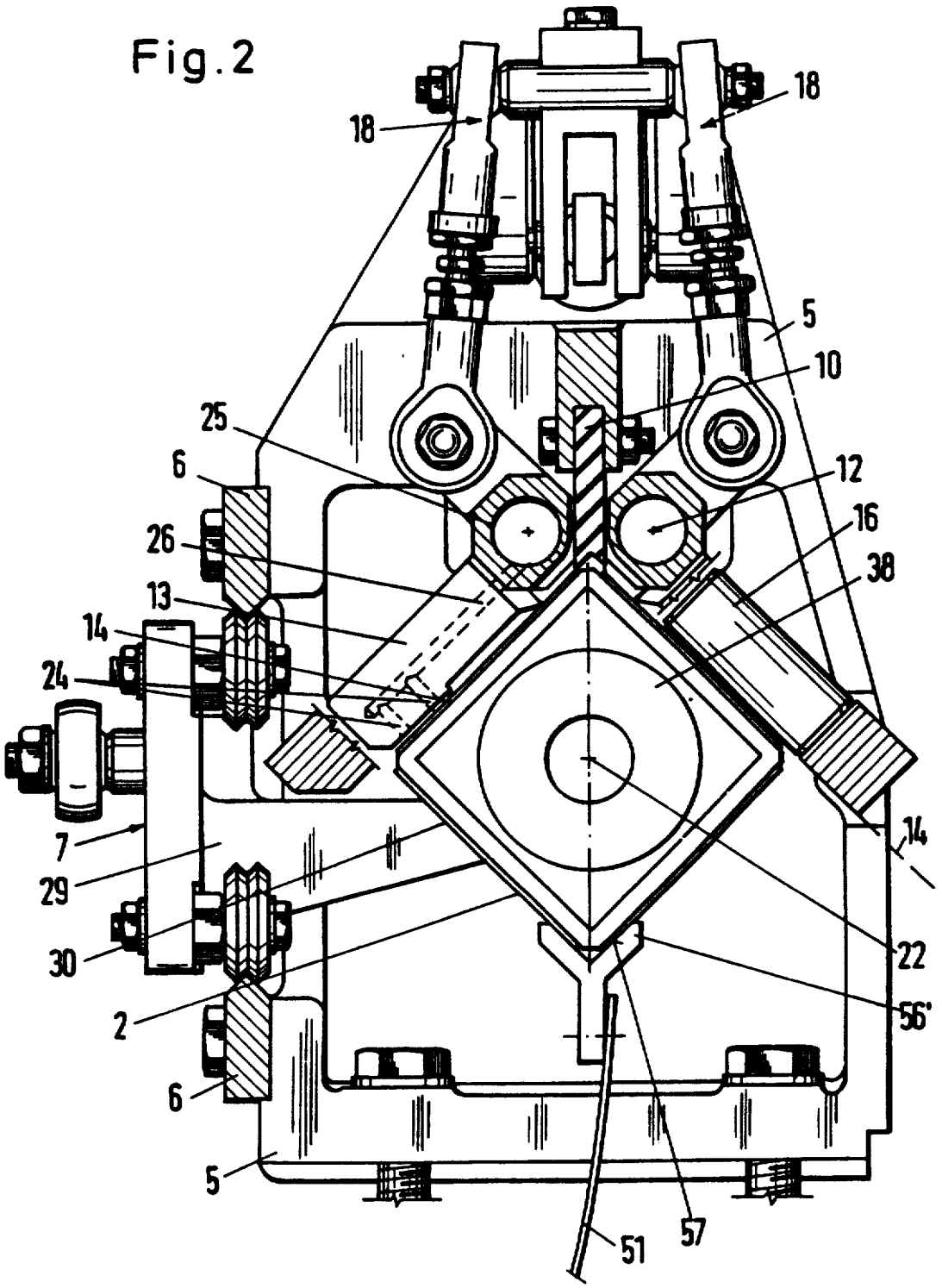
FIG. 2 is a similar view to that in FIG. 1, the sleeve however already being shown in its completely folded-open state.
Figure 4:
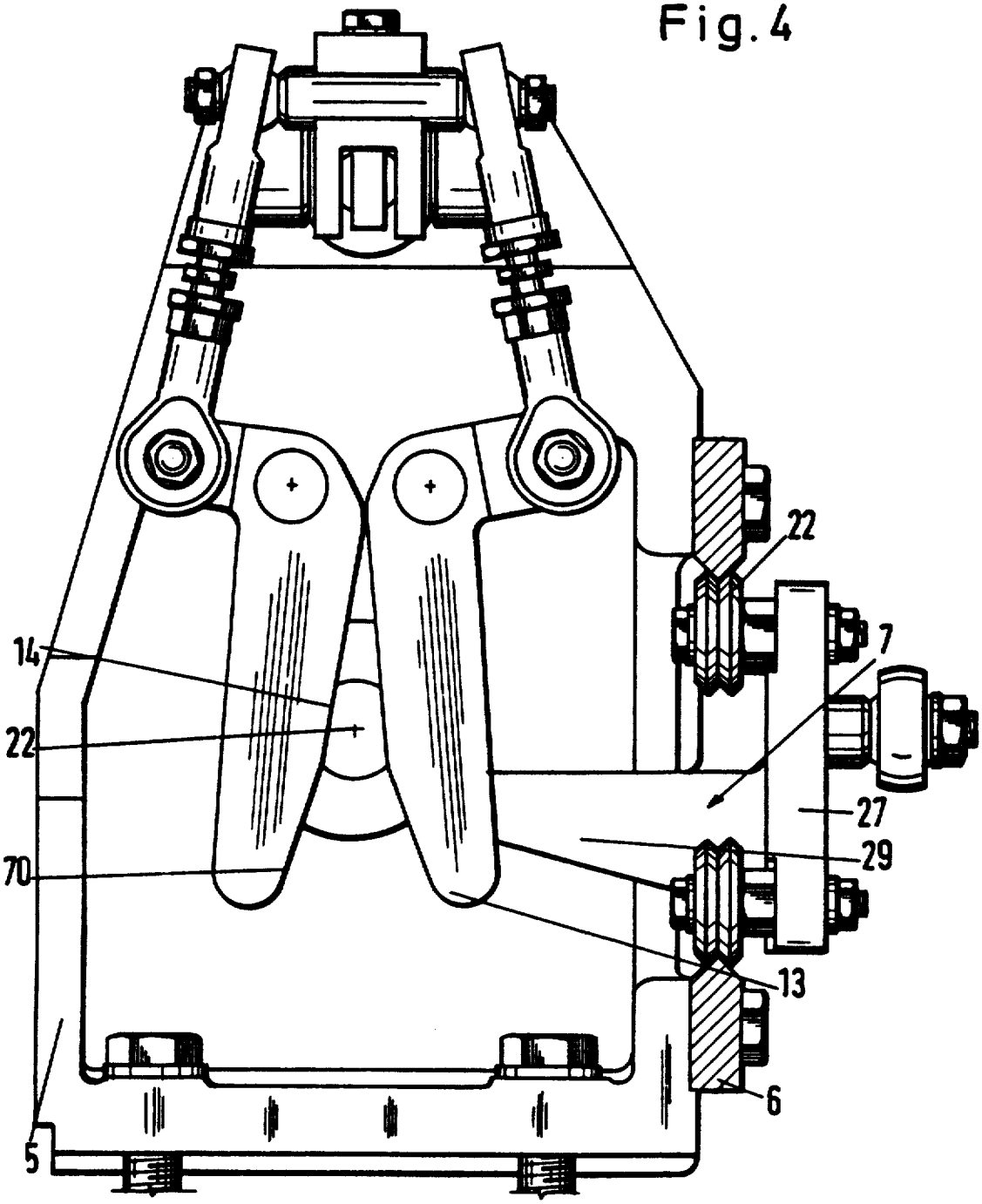
FIG. 4 is a view similar to that in FIG. 1 but in which a different embodiment is shown which has pivoting levers without stationary rollers.
Figure 11:
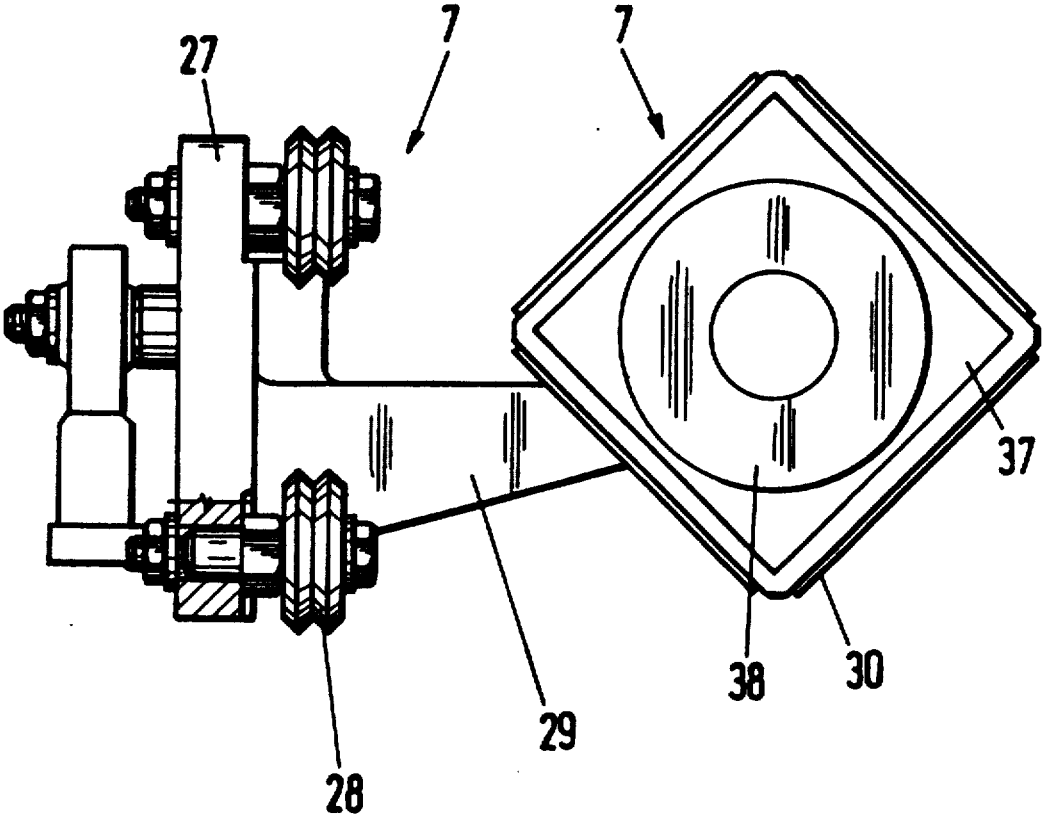
FIG. 11 is a plan view of the end face of the square plate with the raised rubber ring.
Figure 13:
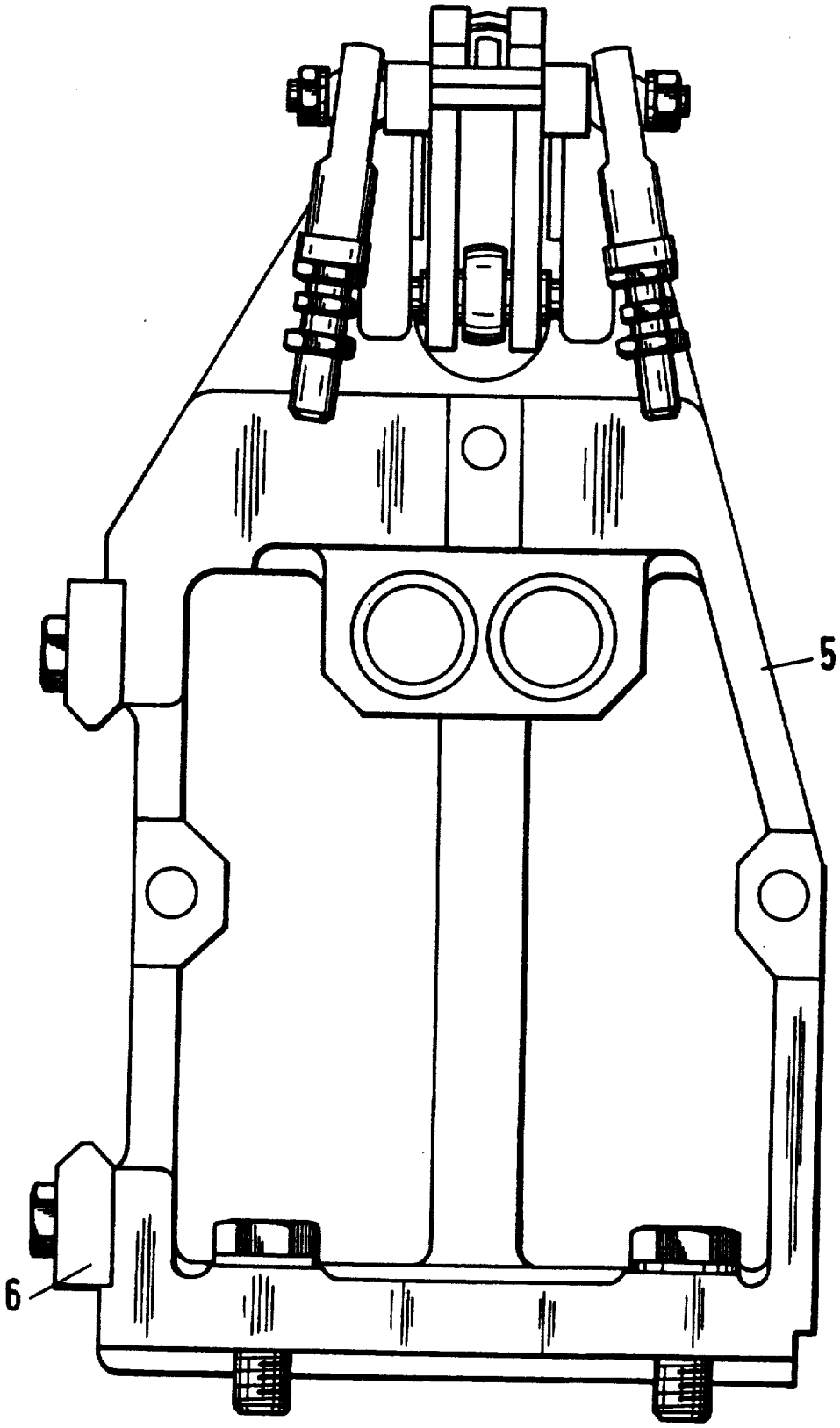

FIGS. 1, 2 and 4 show the frame 5 which is indicated in detail in FIG. 13 and which is connected rigidly to the bottom via the screws which are shown but which are not designated in greater detail. To simplify the drawings, only the right hand (as viewed in the direction of push-on of the sleeves 2) is shown, the man skilled in the art being however required to imagine also a left hand station which is a mirror opposite on the other side of the main central plane. Therefore, where the right hand station shown here is concerned, the frame 5 has on its left hand side rails 6 which serve to guide the ejector, to be described hereinafter and which is generally designated 7 and which is described more accurately in conjunction with FIGS. 10 and 11.

The lying-flat sleeve 2 is intended to be guided by the feeder generally designated 8 into the position in which the sleeve 2 is disposed as shown in FIGS. 1 and 2. In these illustrations, one is looking in the axial direction of the mandrel 9 (shown top right in FIG. 8) and at the ejector 7.

Fixed on the frame 5 is a fold abutment 10 having receiving surfaces 11 disposed in a V-shape and taking the form of a strip which is longer than the sleeve 2. On both sides of and at the level of the fold abutment 10 are the axes 12 of rotation of pivoting levers 13. In the case of a first embodiment, according to FIG. 3 one is looking at a bearing plane 14 in which there are recesses 15 to accommodate rigidly and rotatably disposed rollers 16. A sectional view of this arrangement is shown in FIGS. 1 and 2, in fact on the right, looking at the rollers 16 according to the sectional line I—I and on the left, looking at the lever 13 (alongside the rollers) on the sectional line I'—I' in FIG. 3. Via an air cylinder 17 and generally with driving levers designated 18, the pivoting levers 13 are pivotally driven to rotate about the axes 12. The air cylinder is only required for separate control in the case of the embodiment shown in FIGS. 1 to 3, and in the view in FIGS. 4 and 5, the air cylinder is omitted, but not the drive levers 18 which in the second-mentioned embodiment, are controlled in synchronism by the drive of the distributor-rocker 20 which is shown in FIGS. 6 and 7 (feeder).

In accordance with FIG. 1, the pivoting levers 13 are in a position in which the bearing planes 14 form an acute V angle and the sleeve 2 with the longitudinal sealing seam disposed on the left is shown as having opened up only slightly from the lying-flat state.

Parallel with the direction of view of FIGS. 1 and 2, i.e. at a right angle to the paper plane, there extends not only the longitudinal central axis 21 of the mandrels 9, 9' (FIG. 8) which is parallel but also the axis of rotation 12 of the pivoting levers 13 and also the direction of linear movement of the ejector 7 which extends along the axis 22, namely in the direction of the rails 6. In this direction lies also the longitudinal axis of the strip-like folding abutment 10 and the longitudinal direction of the frame 5.

Figure 3:
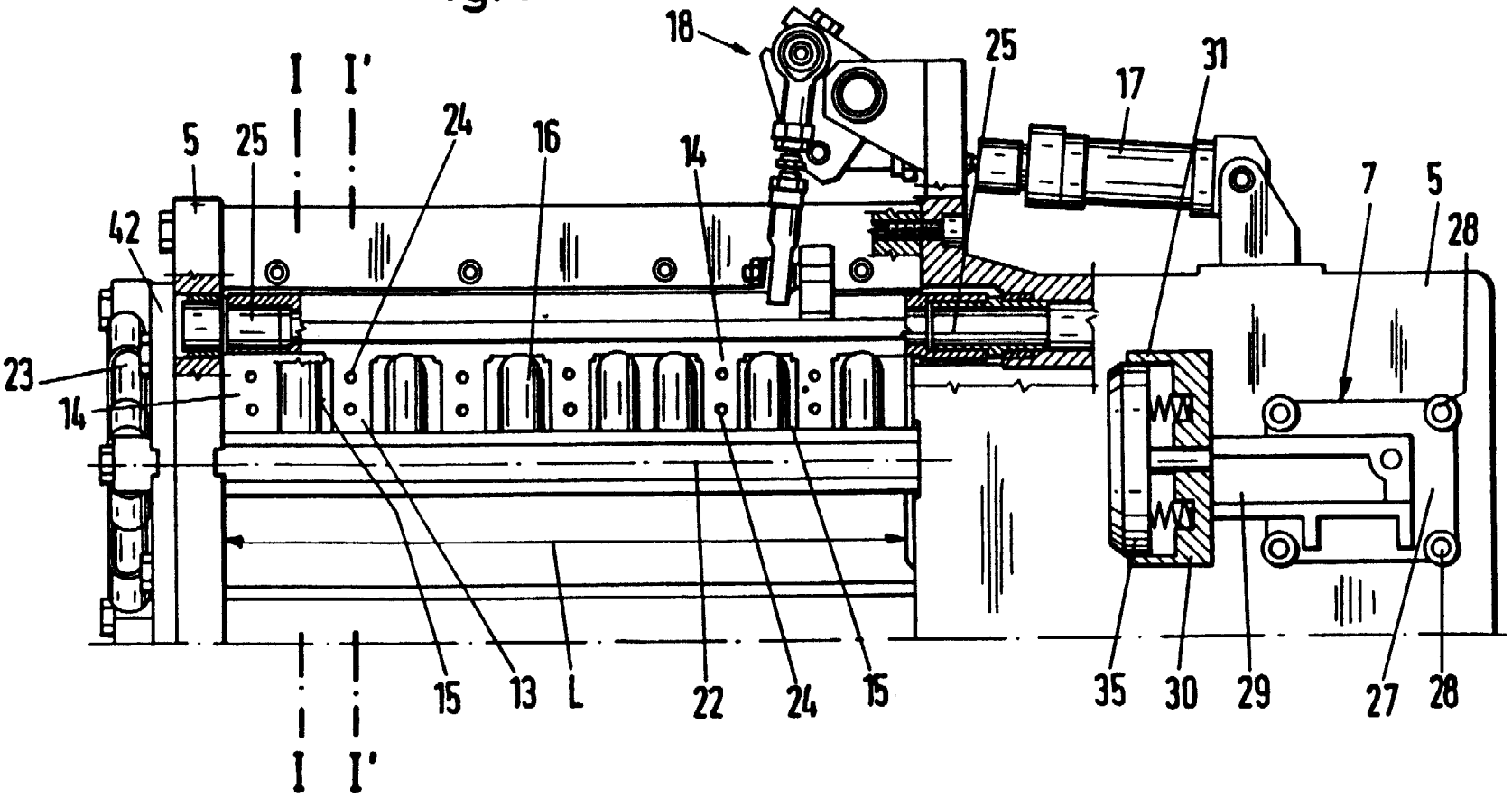
FIG. 3 is a longitudinal section through the folding-open arrangement, substantially through the vertical central line in FIG. 2 with the drive for the pivoting levers.
Figure 12:
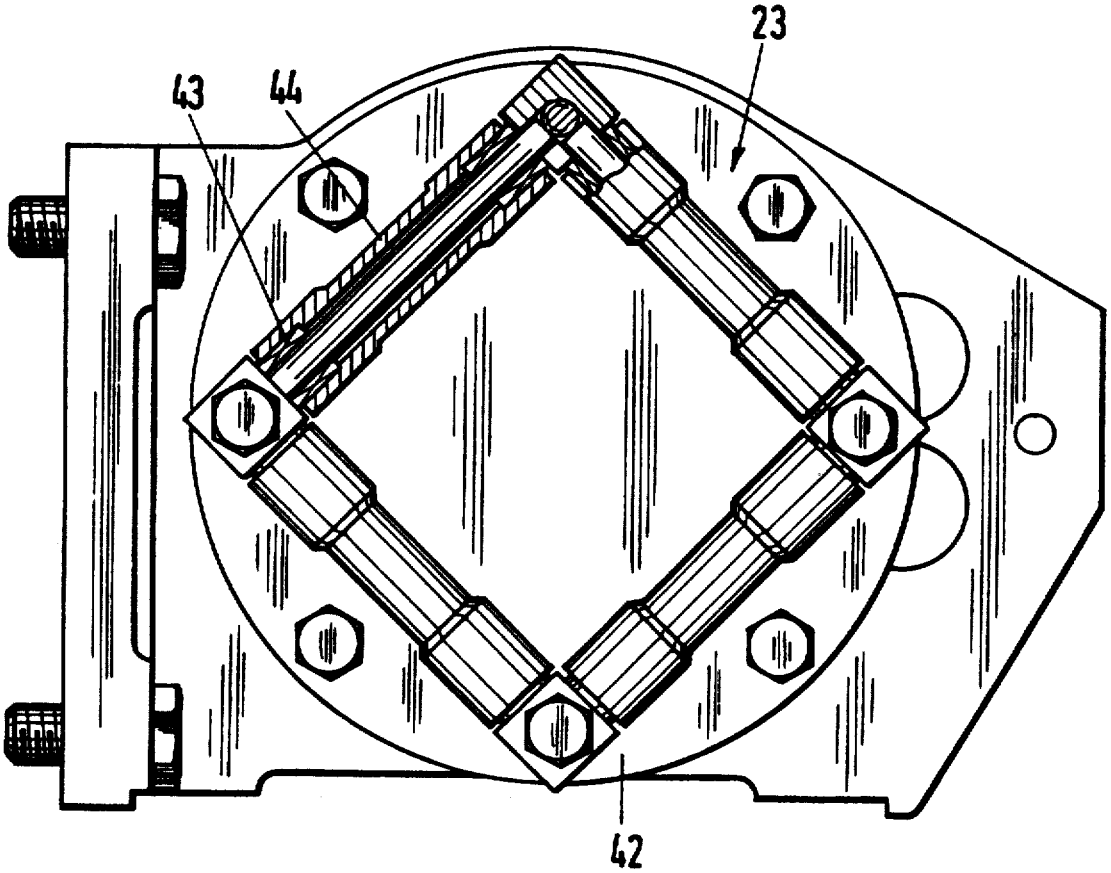
FIG. 12 is a plan view of the guide shown in side elevation on the left in FIGS. 3 and 5 and FIG. 13 is a cross-sectional view through the frame of the folding open arrangement without the ejector and without the pivoting levers.

In FIG. 3, the larger substantially left hand middle part of the folding open space under the folding abutment 10 is shown together with the bearing plane 14 and the rollers 16 while in the right hand third, in the frame 5, the ejector 7 is shown and on the side of the folding open space which is opposite to it, there is shown the guide which is shown in plan view in FIG. 12 and is generally designated 23.

FIG. 3 also shows the vacuum apertures 24 and the vacuum pipe connections 25 in the upper right hand and left hand broken away part while FIGS. 1 and 2 show the vacuum connecting lines 26 between these vacuum lines 25 which extend parallel with the axes of rotation 12, and the apertures 24. Also in the case of the embodiment shown in FIGS. 4 and 5, the vacuum apertures 24 can be seen, except with the difference that the stationary rollers 16 are not to be found on FIGS. 4 and 5.

The ejector will now be described.

Figure 5:
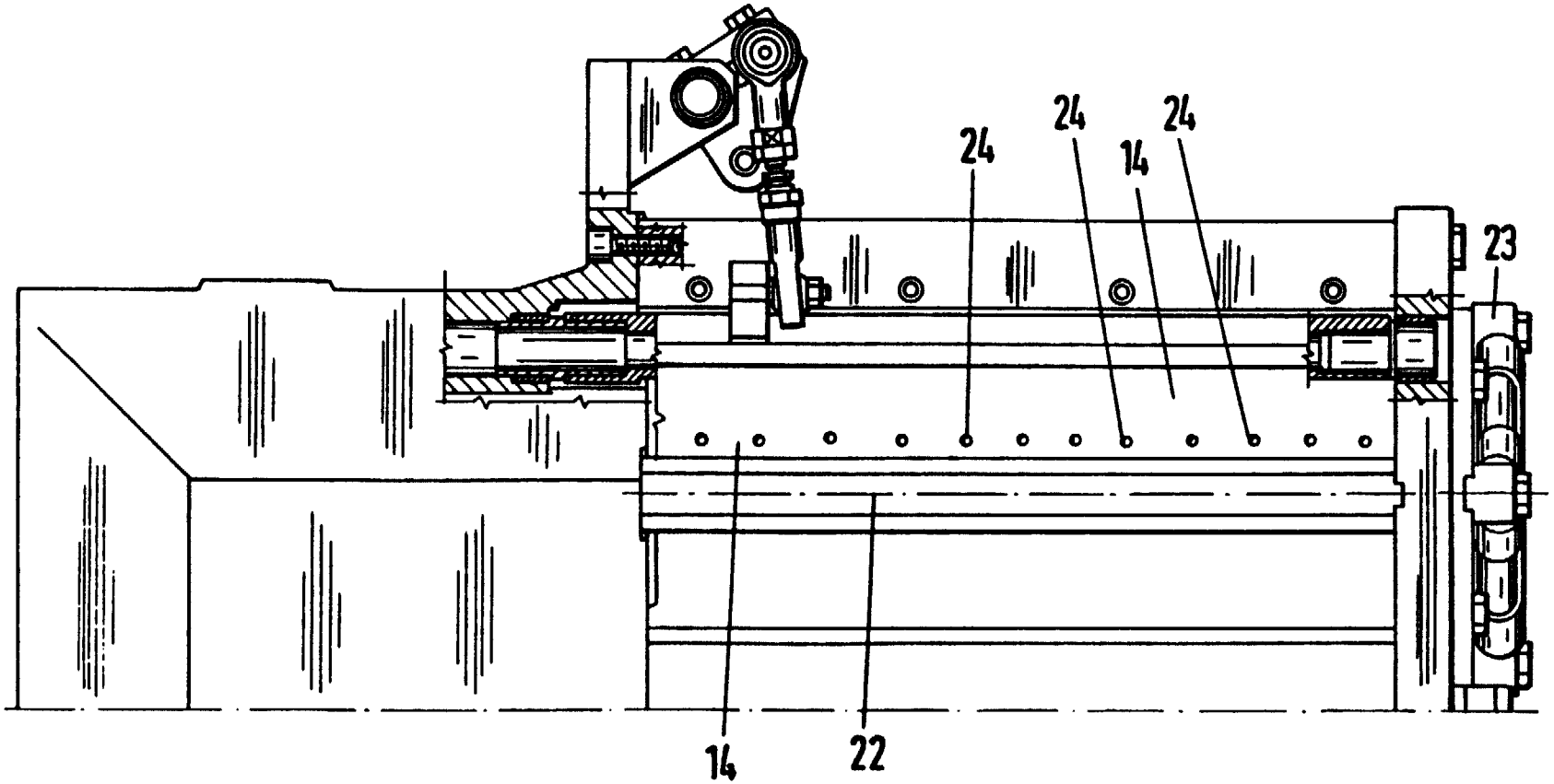
FIG. 5 is a view corresponding to FIG. 3 but refers to the embodiment in FIG. 4 without the stationary rollers.

Its direction of movement therefore extends according to line 22 in FIGS. 3 and 5 or 22 in FIGS. 1, 2 and 4. This direction 22 of movement is predetermined by the rails 6 which extend in the same direction. In these rails 6, four rollers 28 run which are mounted rotatably on a carriage 27. The carriage 27 is connected to the housing 30 of the ejector 7 via a lever arm 29.

By looking at FIG. 10, it can be seen that the steel housing 30 has the form of a beaker having cylindrically formed side walls 31, an axial mounting at 32 and recesses 33 for springs 34 which maintain a square synthetic plastics plate 35 at a distance d from the bottom 36 of the steel housing 30. The end face 37 of the square plate 35 comprises a raised rubber ring 38. Along the peripheral contour, the edge 39 of the square plate 35 slopes obliquely inwardly. In the view in FIG. 4, it is possible also to see the sleeve 2 with its rear edge 40 which alongside the chamfered edge 39 of the square plate 35, rests on the annular end face of the cylindrical side wall 31 of the steel housing 30.

In FIG. 10*a*, on the left, can be seen the front end of the mandrel 9 with its longitudinal axis 21 and end face 41 with a sleeve 2 pushed onto it and of which the rear edge 40 has been pushed by the ejector 7 somewhat farther rearwardly onto the mandrel 9 than would have been possible without the resiliently mounted square plate 35. The distance d in FIG. 10 shows the gap also in the broken away view, bottom left in FIG. 10, in other words the distance by which the rear edge 40 of the sleeve 2 has been pushed rearwardly on the mandrel and passed the leading end face 41 of the mandrel 9.

The guide 23

This guide 23 is shown in FIG. 12 and is mounted on the plate 42. This view shows four rollers 44 rotatably mounted by bearings 43 and so disposed in a rectangle that in its folded-open state, the sleeve 2 bears simultaneously on whatever happens to be the inner line of the rollers 44 and thus enjoys a four-point support. The view shown in the drawings shows the cross-section of the folded-open sleeve 2 to be a square.

The distributor-rocker

The distributor-rocker is designated 20 and is shown in FIGS. 6 and 7. It comprises an arm 50 carrying a retaining plate 51 secured by screws 52 and pivotable about the axis 53 by means of the ball-bearing 54' shown top right in FIG. 7. While the arm 50 of the distributor-rocker 20 extends rectilinearly along a radius, engages around the pivoting spindle 53 and, widening out, strikes the retaining plate 51 and is bent over into an L-shape, as shown in FIG. 7, the retaining plate 51 has the form of a partly cylindrical shell having two arcuate edges 54' on the right and left in FIG. 7 and at the front-the curved double line-in FIG. 6; and two straight end edges 55, the end points on the right and left in FIG. 6 and the straight double line in FIG. 7. At the two straight end edges 55 of the retaining plate 51 there are centring webs 56 provided with cross-sectionally V-shaped outwardly standing receiving surfaces 57 (on the right and left). The centring webs 56 have the length of the straight end edge 55 and thus they are strip-shaped. Their length is substantially equal to the length of the sleeve 2 and is thus also substantially equal to the length of the fold abutment 10.

Figure 8:
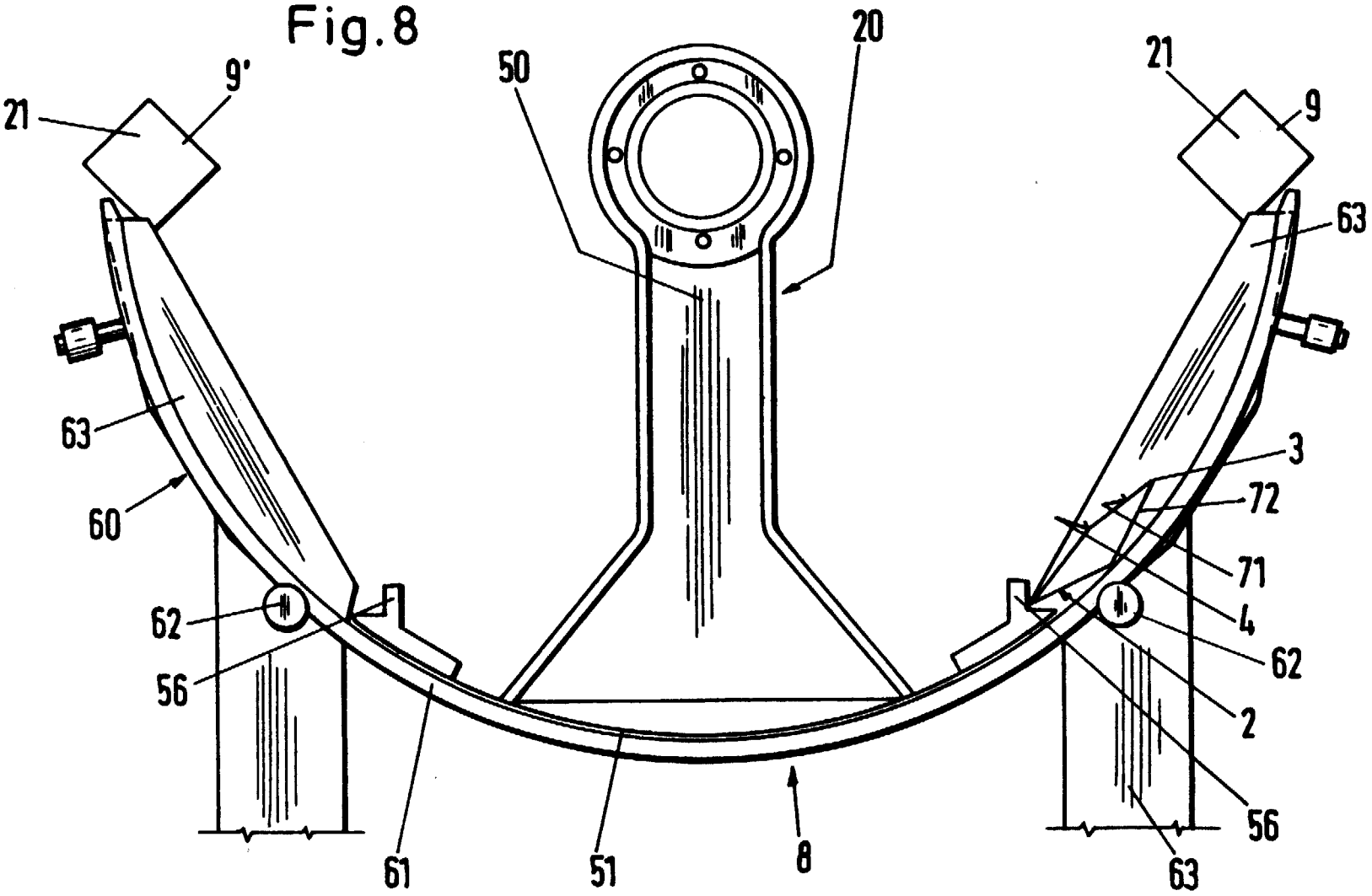
FIG. 8 is a plan view of the arcuately formed basket which is shown in FIG. 6, only broken away in the bottom right hand part.
Figure 9:
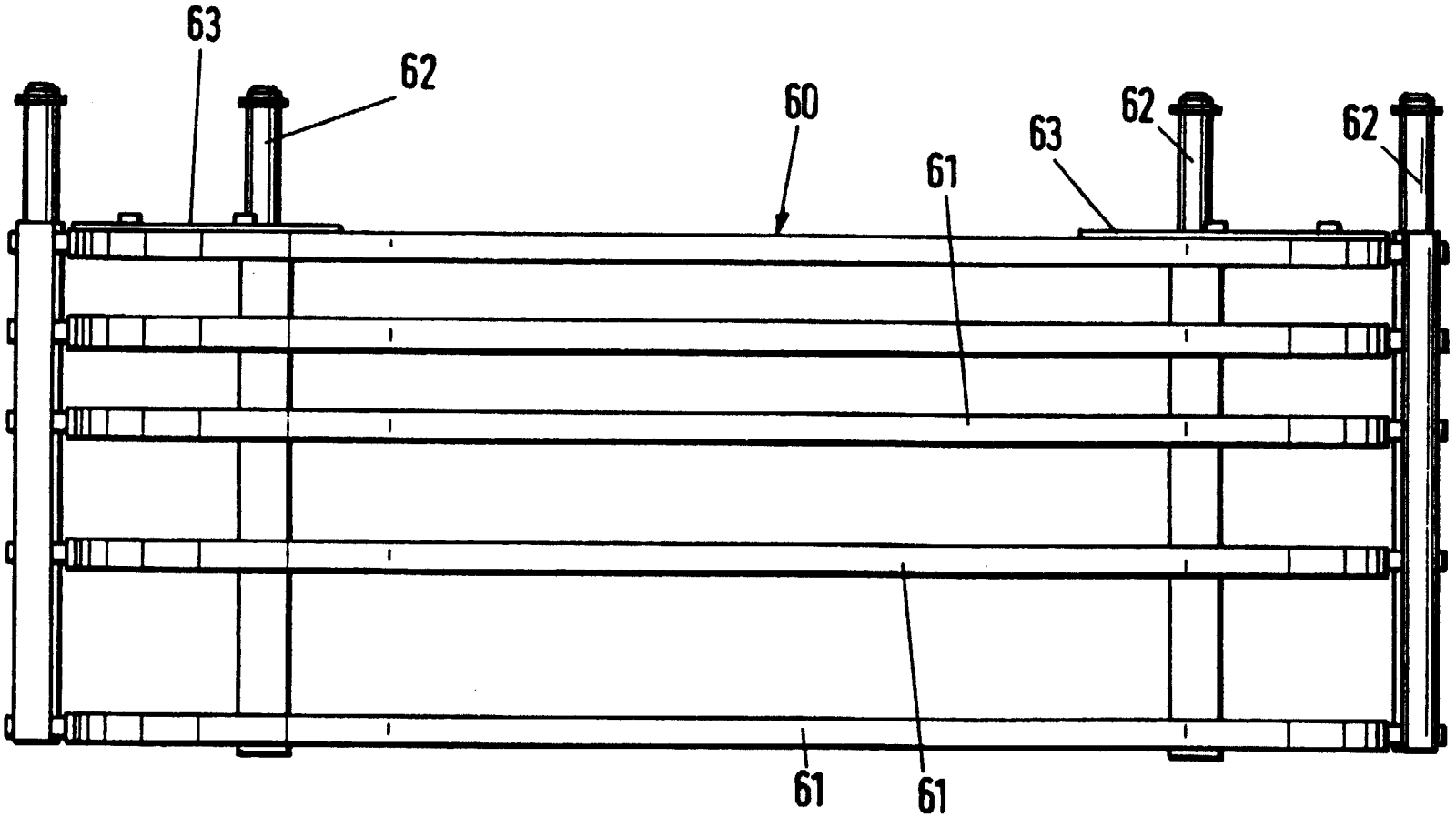
FIG. 9 is a plan view of the basket shown in FIG. 8.

A basket 60 shaped like part of a cylindrical shell and shown in side view in FIG. 8 and plan view in FIG. 9 and which is likewise part of the feeder 8 is constituted by bent rods 61 and (disposed transversely through these mutually parallel rods 60) four carrier bolts 62. The basket stands on stationary supports 63 shown in FIG. 8 and rigid on the ground. FIG. 7 also shows the arcuately and parallel spaced-apart cross-sectionally rectangular rods 61 which form the basket 60 shown also on the right in FIG. 6. Two small guide plates 63 ensure bearing of the sleeve 2 shown in the right in FIG. 8 on the upper side in FIG. 9 as a means of guiding the movement of the sleeve 2 during the movement of the distributor-rocker 20 through a quarter of a circle as shown in FIG. 8, from the six o'clock into the three o'clock positions.

In operation, the sleeve 2 is in the magazine 1 shown in FIG. 7, initially singled-out but flat at the bottom, lying on the arcuate square rods 61 of the basket 60, the longitudinal sealing seam 4 being disposed at the top. After separation, the lying-flat sleeve 2 will have sprung open somewhat so that its cross-section is rhombic. The so-called "first" lateral fold edges are at this time strongly folded and FIG. 6 shows the right hand front longitudinal fold edge 3 while the other two mutually opposite fold edges, one of which is disposed alongside the longitudinal sealing seam 4, are only slightly folded or almost unfolded. In this state, the receiving surface 57 which is opened up V-wise receives the left hand tip of the sleeve 2 when the arm 50 of the distributor-rocker 20 has substantially reached an eight o'clock or seven o'clock position and starts its swinging movement in an anti-clockwise direction. When the distributor-rocker 20 has exactly reached its six o'clock position, as shown in FIG. 6, then it has already pushed the still partly flat sleeve 2 in front of it for a distance and this movement is continued until the situation in FIG. 1 has been reached.

FIG. 1 shows the two pivoting levers 13 still quite closely adjacent each other so that their bearing planes 14 constitute a very pointed 'roof', the V of which only makes a small angle. The centring web 56 now has reached the position shown in FIG. 1 because the front lateral fold edge 3 of the sleeve 2 has just reached the point of the V of the fold abutment 10 between the receiving surfaces 11. As can be seen particularly clearly from FIG. 4, the pivoting levers 13 may in their bottom portion comprise funnel-shaped chamfers 70 so that the front lateral fold edge 3 of the sleeve 2 can be pushed well forwards into the V-shaped space until it is under the fold abutment 10. At this moment, the bearing planes 14 with the vacuum apertures 13 are bearing on the two oppositely disposed side faces 71 and 72 of the sleeve 2 which are connected to each other also via the lateral fold edge 3. The control means switches on the vacuum so that these adjacently disposed side faces 71, 72 are maintained attracted by suction by the pivoting levers 13.

Now the folding-open process is initiated because upon further arcuate movement of the distributor-rocker 20 and thus of its centring web 6 upwardly in FIG. 1, now, the position shown in FIG. 1 is left in order to assume the position and folded-open state shown in FIG. 2. The pivoting levers 13 move apart from each other, enlarging the angle of the bearing planes 14 enclosed between them, until the centring web of the distributor-rocker 20 has reached the position shown in FIG. 2, at 56'. In this position, also the sleeve 2 has reached its square shape (in cross-section). The sleeve 2 now has its side wall 71 bearing on the bearing plane 14 of the left hand pivoting lever 13 when one is looking at the section line I'—I' in FIG. 3 and on the opposite side on the stationary roller 16, when one is looking at the section I—I in FIG. 3.

Upon further upwards pivoting of the pivoting lever 13 in the direction which enlarges the angle enclosed by its bearing planes 14, the side faces 71 and 72 of the sleeve come to bear on the rollers 16 while the centring web 56 continues its movement downwards again from its position 56' and while also the ejector 7 is commencing its movement leftwards out of the position shown on the right in FIG. 3.

The sleeve has a rear edge 40 which first comes into engagement with and is held by the square 35 of the ejector 7, as shown on the left in FIG. 10.

During further movement of the ejector 7 leftwards in the view in FIG. 3, understandably the front edge which is opposite the rear edge 40 of the sleeve 2 is pushed into the guide 23 so that the sleeve 2 is now held at the front by the sleeve 23 and at the rear by the square plate 35. Therefore, supporting of the edge of the sleeve 2 which is opposite the lateral fold edge 3, by using the centring web 56, is no longer needed which is why, upon pivoting of the distributor-rocker 20 in a clockwise direction, the centring web 56 is moved away in the other direction.

In the meantime, the ejector 7 has already pushed the sleeve 2 onto the mandrel 9 and now the rubber ring 38 of the ejector 7 engages the end face 41 of the mandrel 9 so that the cylindrical side wall 31 of the steel housing 30 pushes the rear edge 40 of the sleeve 2 farther while, as the springs 34 become compressed, the square plate 35 remains in the housing 30 because it is braced by the front end 41 of the mandrel 9. This pushing movement takes place lengthwise of the gap d as can be seen in FIG. 10 and from the small broken-away view underneath it.

The ejector 7 has now performed its forwards movement which is longer than the length L of the pivoting lever 13 in FIG. 3.

In the meantime, the distributor-rocker 20, via the left hand centring web 56 and the receiving surfaces 57, has taken hold of the next singled-out and still almost flat sleeve 2 which now upon further rotary movement in a clockwise direction about the axis 53 produces an arcuate displacement leftwards (FIG. 8) in the direction of the position between the other ejector, not shown, and the mandrel 9'. In the meantime, the pivoting levers 13 will have moved back out of the position of the opened-out V through the position in FIG. 2 and into the position shown in FIG. 1. Whereas, now, according to FIG. 8, in the top left hand part the sleeve 2 will have been pushed onto the mandrel 9', once again the next singled-out sleeve 2 will be grasped and pushed onto the right hand mandrel 9 so that the above-described cycle will be repeated, starting from the position shown in FIG. 1.

In the case of the embodiment shown in FIGS. 4 and 5, the way this works is the same except that to simplify the machine, the stationary rollers 16 have been omitted and the bearing planes 14 of the pivoting levers 13 are now only interrupted by the vacuum apertures 24, being otherwise flat surfaces. Also, the pivoting levers are controlled in synchronism via drive means, not shown, for pivoting the distributor-rocker 20 so that the air cylinder 17 in the embodiment shown in FIG. 3 is in this case absent in the embodiment shown in FIG. 5.

Having thus described my invention, I claim:

1. Apparatus for opening flat folded packaging sleeves, each sleeve including a longitudinal sealing seam, and for positioning said opened sleeve in axial alignment with an elongated mandrel complementally configured to receive said sleeve, comprising in combination (1) a source of separate flat folded packaging sleeves, (2) an ejector adapted to engage one end of an opened sleeve, said ejector being spaced apart from said mandrel and being adapted for reciprocating linear movement with respect to said mandrel, (3) feeder means for grasping a flat folded sleeve and positioning it in axial alignment between the mandrel and said ejector, said feeder means comprising a distributor-rocker which is pivotable about an axis parallel with the direction of linear movement of the ejector so as to move a sleeve through a quarter-circle from the source thereof to said axial alignment (4) a V-shaped abutment means positioned to receive a leading folded edge of a sleeve in its axially aligned position, (5) a pair of pivotable lever means positioned contiguously to said V-shaped abutment means and including elongated plane surfaces having vacuum apertures formed therein, whereby a folded sleeve in axial alignment is positioned to be opened upon pivoting and vacuum actuation of said lever means and vacuum apertures.

2. Apparatus according to claim 1, wherein the distributor-rocker comprises a radial arm having fixed to its outer end an arcuately shaped retaining plate having affixed to a straight edge thereof outwardly directed elongated V-shaped receiving surfaces adapted to grasp a flat folded sleeve.

3. Apparatus according to claim 2, wherein a V-shaped receiving surface is affixed to each straight edge of the arcuately shaped retaining plate, and the distributor rocker is adapted to be pivoted through a quarter-circle clockwise and counterclockwise from said source of sleeves.

4. Apparatus according to claim 1 or 2, wherein the V-shaped abutment means comprises an elongated strip, the length thereof being longer than that of a sleeve and substantially equal to the length of the axial dimension of the pivotable lever means.

5. Apparatus according to claim 1, wherein the elongated plane surfaces of the pivotable lever means have recessed therein a plurality of rollers adapted to accommodate the linear movement of a sleeve toward the mandrel.

6. Apparatus according to claim 1, wherein a square shaped arrangement of four guide rollers, said arrangement being adapted to support the sides of an opened sleeve, is mounted axially of and beyond the farthest extent of linear movement of the ejector towards the mandrel.

7. Apparatus according to claim 1, wherein the ejector comprises a square plate which is chamfered so as to receive and complementally configured to the peripheral contour of an opened sleeve, said square plate being resiliently mounted in a beaker shaped housing.

8. Apparatus according to claim 7, wherein said square plate contains an elastomeric raised surface protruding from its exposed plane surface.

* * * * *